United States Patent [19]

Hartmann et al.

[11] 3,991,250

[45] Nov. 9, 1976

[54] SPUNBONDED FABRICS OF NYLON-6 FILAMENTS

[75] Inventors: Ludwig Hartmann; Lueder Gerking; Gerhard Mueller, all of Kaiserslautern, Germany

[73] Assignee: Lutravil Spinnvlies GmbH & Co., Kaiserslautern, Germany

[22] Filed: Feb. 10, 1975

[21] Appl. No.: 548,180

[30] Foreign Application Priority Data

Feb. 9, 1974 Germany ..... 2406321

[52] U.S. Cl. ..... 428/288; 156/83; 156/167; 156/433; 265/210 F; 428/290; 428/297; 428/425; 428/474; 428/910

[51] Int. Cl.[2] ..... B32B 5/08

[58] Field of Search ..... 156/167, 178, 179, 180, 156/181; 264/210 F; 428/288, 290, 296, 910, 361, 225, 297, 425, 474, 83

[56] References Cited

UNITED STATES PATENTS

| | | | |
|---|---|---|---|
| 2,336,743 | 12/1943 | Manning | 156/74 |
| 2,336,745 | 12/1945 | Manning | 264/10 |
| 2,411,660 | 11/1946 | Manning | 156/167 |
| 2,522,527 | 9/1950 | Manning | 156/167 |
| 3,117,055 | 1/1964 | Guandique et al. | 428/290 |
| 3,341,394 | 9/1967 | Winney | 428/225 |
| 3,502,763 | 3/1970 | Hartmann | 264/210 F |
| 3,509,009 | 4/1970 | Hartmann | 264/210 F |
| 3,555,139 | 1/1971 | Waters et al. | 264/210 F |
| 3,686,066 | 8/1972 | Peters | 428/296 |
| 3,692,618 | 9/1972 | Dorschner et al. | 428/296 |

*Primary Examiner*—James J. Bell

*Attorney, Agent, or Firm*—Johnston, Keil, Thompson & Shurtleff

[57] ABSTRACT

A spunbonded fabric of nylon 6, bonded by binders such as polyacrylates and polyurethanes, in which the filaments are substantially in the γ-modification in the crystalline regions and the average molecular orientation, produced by attenuation, of the nylon 6 filaments is at most 80% of the theoretically possible orientation. It is an object of the invention to produce spunbonded fabrics of improved properties and to do so more economically, e.g. with higher outputs.

9 Claims, 2 Drawing Figures

SPUNBONDED FABRICS OF NYLON-6 FILAMENTS

This application discloses and claims subject matter described in German Patent Application P 24 06 321.6, filed Feb. 9, 1974, which is incorporated herein by reference.

The invention relates to spunbonded fabrics of textile character which perform well in use, with regard to scuff resistance and easy-care properties, and to processes for their manufacture.

It is known to bond nonwovens by means of binders. Thus, U.S. Pat. No. 3,117,055 describes nonwovens of continuous filaments, in which the freshly spun filaments pass through a crimping device and are then laid down to form a web which is impregnated with a polymeric binder, which may be in the form of a dispersion, and the binder is crosslinked at the cross-over points of the filaments during drying.

U.S. Pat. No. 2,719,806 and Swiss Patent 317,080 disclose bonding webs by means of foamed agents. A double treatment of the webs, successively from each side, is described. In these patents, staple fibers, but not continuous filaments, are converted to a nonwoven.

Nonwovens of continuous filaments show special properties because the innumerable anchoring points of the filaments in the nonwoven have a very beneficial effect on the scuff resistance. Furthermore, these nonwovens have high tensile strengths and tongue tear, compared to nonwovens of staple fibers.

If such continuous filaments are manufactured by the spunbonding process, there is the further advantage that in contrast to staple fibers, the filaments are free from lubricants or other substances which modify their surface. The adhesion of the binder is improved, so that improved scuff resistance again results. Such a nonwoven of nylon-6 filaments bonded with polyacrylate dispersions is described in German Patent Application P 15 60 809.9, where a scuff-resistant, easy-care lingerie fabric is obtained by twice impregnating filaments of a certain spectrum of diameters, in such a way that in the course of the drying process which follows the individual impregnation processes the binder accumulates, through migration, on the surfaces of the web.

It is an object of the present invention to produce spunbonded fabrics of the said type having further improved properties, and to do so more economically, ie. with higher outputs.

The invention relates to a spunbonded fabric of continuous nylon-6 filaments bonded by binders such as polyacrylates and polyurethanes, in which these filaments are substantially in the $\gamma$-modification in their crystalline regions and the average molecular orientation, produced by attenuation, of the nylon-6 filaments is at most 80% of the theoretically possible orientation.

The average gauge of the filaments normally lies within the fine textile range, ie. from 0.4 to 2 dtex, but is not restricted thereto and can definitely exceed 3 dtex. Such coarser gauges are desirable, eg., to provide higher air permeability in the case of fabrics for outerwear, but reduce the covering power, the so-called opacity, of the nonwoven.

The invention further relates to a process for the manufacture of spunbonded fabrics of this type from nylon-6 filaments which are melt-spun, attenuated by air jets, laid down to form a web and bonded by one or more applications of a binder and subsequent drying, wherein the nylon-6 filaments in the unbonded web are caused to swell and extend by absorption of water.

With regard to the definition of the $\gamma$-modification, reference should be made to the following publication: "Spinnprozess und kristalline Struktur von Perlonfäden" ("Spinning Process and Crystalline Structure of Perlon Filaments") in Angew. Chem., 74 (1962), page 562.

The webs produced from continuous nylon-6 filaments are usually twice impregnated, preferably with polyacrylate binder dispersions, and are then bonded.

A scuff-resistant, easy-care textile fabric is essentially characterized by the following properties: it should show little surface scuffing ("pilling") during wear and as a result of the frequently high mechanical stresses to which it is exposed in washing; it should, to accord with the definition of easy-care, be smooth after washing, without requiring ironing; and it should be wrinkle-resistant and have a soft hand.

The spunbonded fabrics of the invention exhibit all these properties to a high degree. Higher throughputs and higher deniers compared to conventional processes are achieved, which makes the process more economical; furthermore, the strength of these spunbonded materials shows a substantial improvement, in spite of higher throughputs and coarser gauges, because of the greater degree of attenuation which the individual filaments have undergone.

We have found that in manufacturing spunbonded fabrics it is advantageous to lay down the filaments in a finely looped tangled arrangement to form a nonwoven. This ensures, a priori, good scuff resistance and a soft hand, which is advantageous if the nonwoven is to be used as a textile material, and contributes to the ease with which stresses within the nonwoven are released, which is of importance for ensuring wrinkle recovery after washing.

In addition to the pattern in which the filaments are laid down, the physical structure of the nylon-6 filaments also has a decisive influence on the performance of the nonwovens in use. Finally, another preferred parameter is the bonding of the filaments by a special type of impregnation.

The physical structure is determined by the molecular orientation of the filaments caused by drawing, by the degree of crystallinity and by the crystal structure. We have found that excessive orientation of the filaments through excessive drawing causes stresses which produce an uneven surface after washing, for example in a conventional domestic washing machine at 60° C. This lack of smoothness can be counteracted by carrying out the process in such a way that the filaments are only drawn to a certain degree, not to the maximum possible degree. The crystallinity is closely related to the orientation, which, as is known, can be measured by the birefringence. If a high degree of crystallinity is produced before the filaments are laid down, the filaments are stiff and cannot be laid down in the desired tangled form.

We have now found, surprisingly, that the requirements in question are best met, and the good end-use performance of the nonwoven is achieved, if the filaments are so spun that when laid down to form the web they are substantially in the $\gamma$-modification in their crystalline zones. Using the process of the invention it is possible to produce a very stable $\gamma$-modification, not known from conventional spinning technology, which essentially remains preserved during the subsequent heat treatment, i.e. when drying the impregnated web.

If the nylon-6 polymer used is spun by a conventional process, an unstable $\gamma$-modification of the crystal structure is in fact first obtained in some cases, but this modification easily changes to the $\alpha$-modification, which is always the more stable, through brief heating, especially in a moist atmosphere. In contrast, the spunbonded fabrics of the invention exhibit a surprisingly stable $\gamma$-modification which is only partially converted to the $\alpha$-modification on prolonged heating, for example for 30 minutes at 150° C. As a result of this feature of a stable $\gamma$-modification in the crystalline regions of the filament it proves possible to manufacture nonwovens having the desired good wash resistance and dimensional stability, even when using higher throughputs of the melt, higher than conventional drawing ratios and, if desired, higher filament deniers.

According to a further embodiment of the invention, the textile hand, i.e. the drape of the nonwoven, can be influenced by passing the unbonded web, between being laid down and the first impregnation, through a humid atmosphere in which the nylon-6 filaments take up moisture (water). As a result of this water absorption, which can be up to 4 percent by weight, the filaments swell and extend. If this treatment is carried out whilst holding the filaments at discrete points during swelling on a perforated belt, by applying suction below the latter, there occurs, in addition to the finely tangled arrangement of the filaments produced during laying down, a fine arc-shaped deflection of the filaments, in the main in the 3rd dimension, that is to say at right angles to the face of the web. As a result, the web becomes bulkier and softer. Furthermore, stresses are more easily released because the finely wrinkled structure produced by swelling helps to release stresses which occur after washing. Thus the formation of rigid layers (plywood effect) is avoided and an "internally hinged" structure is produced. We have found that this property is much more pronounced if the filaments crystallize in the main in the $\gamma$-structure.

Figure 2:
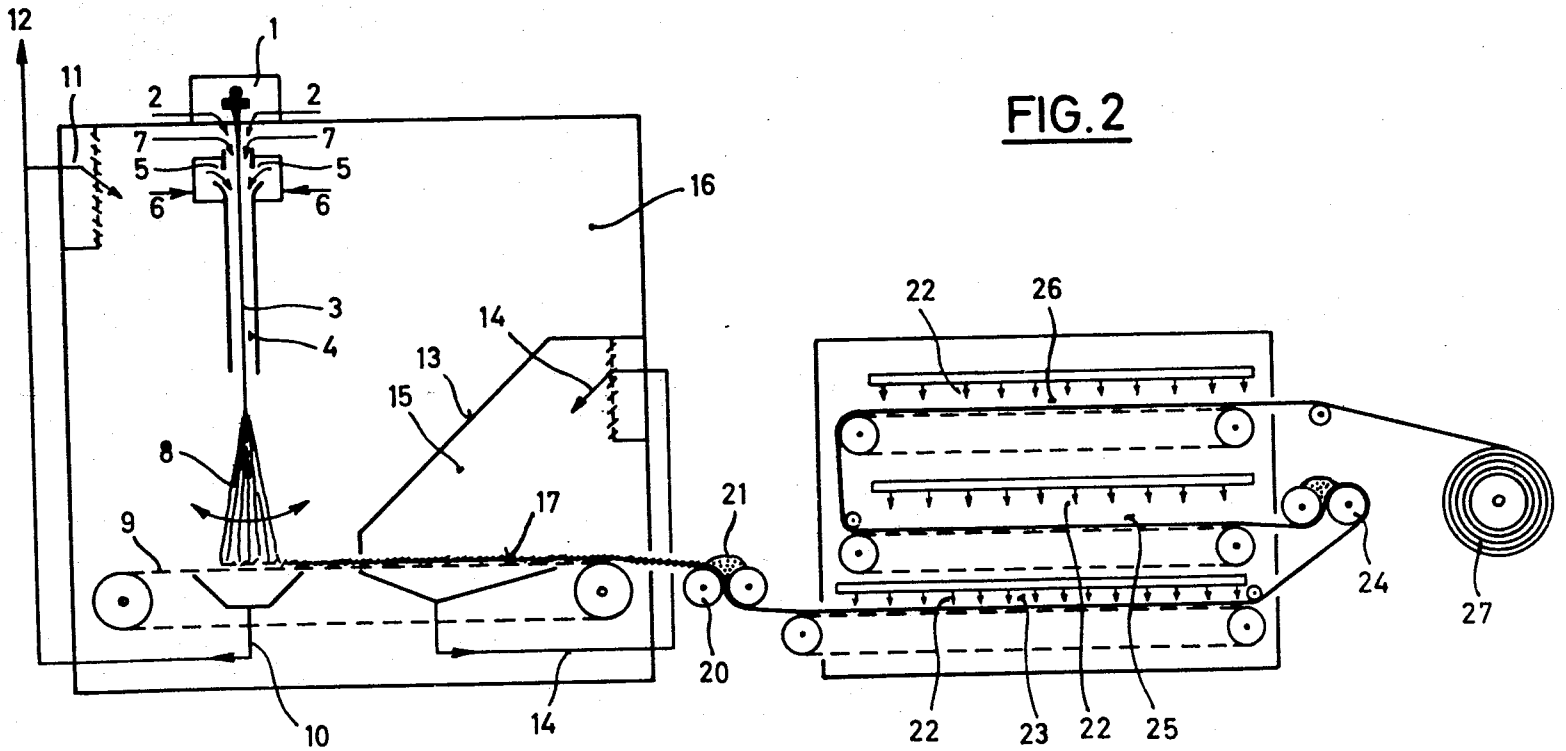
FIG. 2 shows a flowsheet illustrating the process according to the invention. The web is bonded by impregnation with a foamed binder dispersion, preferably of acrylic resins.

The nylon-6 melt which has been prepared conventionally, for example in extruders, is spun through spinnerets 1, of which FIG. 2 only shows one schematically, but of which there are several, preferably parallel to one another, arranged at an angle above the conveyor; the melt issues vertically downward from a row of spinning holes provided in the middle of the spinneret. On both sides of this row of spinning holes, air issues at high speed and at about the same temperature as the melt. These jets of air, also referred to as primary air, are indicated by arrows 2. The bundle of filaments 3 then enters an injector tunnel 4 into which air 6, the so-called tertiary air, is blown laterally through slits 5, at an acute angle to the direction of travel of the filaments in the tunnel. This air exerts friction on the surface of the filaments, which travel more slowly, and serves, additionally to the primary air 2, to draw the filaments. It plays the major part in the drawing operation. As a result of the injector action of the tunnel, so-called secondary air 7 is also drawn into the tunnel from the atmosphere. After leaving the tunnel, the bundle of filaments is reciprocated, in the collecting zone 8, by methods not shown, above the conveyor belt 9, so as to produce as uniform laying-down as possible. The bundle of filaments can be deflected by moving the tunnel or by the aerodynamic action of the air jet issuing from the tunnel. For the latter, it is possible to utilize the Coanda effect or to deflect the bundle of filaments rhythmically by jets of air blown in laterally. The filaments are laid down on belt 9 to form web 17 whilst the air flows through the belt and is removed by suction below the belt, as shown schematically by arrow 10. Since the air 7 in the spinning chamber must conform to certain temperatures and humidities in order to obtain the desired filament structure, it is economically desirable to recycle the greater part of the air removed by suction to the spinning chamber, as shown by arrow 11. The rest can be discharged into the atmosphere as waste air 12.

The advantageous treatment of the web by swelling in a moist atmosphere is preferably carried out on the same perforated belt but can take place in a spatially separate atmosphere, as indicated by a partition 13. As in the case below lay-down zone 8, appropriate suction and air inlet devices can be provided in this conditioning zone 15 though the flow which they produce is generally far less than that in the lay-down zone; the flow is shown by arrow 14. The equipment for conditioning the air 11 fed to the spinning chamber, and the subsequent conditioning zone 15, are not shown but are conventional ventilation and air-conditioning equipment.

After leaving the spinning chamber 16 or the chamber 15, the web 17 is impregnated in an impregnating device 20 between two rollers. For this purpose, an aqueous binder dispersion 21 which has been foamed up with air is introduced into the upper nip between the two rollers, which are located horizontally alongside one another. The web takes up the binder dispersion in the main on its surface and then passes into a dryer where it is dried conventionally by hot gases, preferably air 22, which is blown against the web from above and optionally also from below. After the first impregnation and drying in a part of the dryer 23, the other side of the web is impregnated in a device 24 which is identical to the device 20 and is then dried in the drying zone 25. The product can then be exposed to a 3rd heat treatment at 26 to condense and crosslink the binder, and is then wound up at 27.

An essential factor in the bonding of the web is the formulation of the binder, whilst the use performance of the nonwoven is essentially affected by the migration of the binder which takes place in the dryer and is associated with the drying process. By selection of the binder concentration in the aqueous dispersion and selection of the density of the foam it is possible to ensure that the binder accumulates at the surfaces during the drying process and thus to achieve high scuff resistance through good bonding of the surface layer.

The particular crystal structure of the laid-down filament which is desired according to the invention is achieved by accurately suiting the temperature and humidity of the air 7 in the spinning chamber (the secondary air) to the tertiary air 6. As regards the latter, the temperature and humidity are also important, but the most important factors are the amount fed into the tunnel 4 and hence the air velocity in the tunnel, since it is responsible for the orientation of the filament, especially at the desired high throughputs of melt. If the filament is drawn excessively by large amounts of tertiary air which enter the tunnel 4 through the slits 5, the crystallinity of the filament, which is closely associated with its orientation, can be excessive, in which case the filaments are too stiff and cannot be laid down in the desired fine curls and loops. Heavy pigmentation of the filament raw material, for example by titanium dioxide, can be a similar handicap, since there may then be too many crystal seeds in the polymer.

By balancing the above material flows and temperature and humidity conditions, which presents no problems to those skilled in the art, filaments can be produced by the process which assume a $\gamma$-crystal structure which is unusually stable for nylon-6. This structure essentially remains preserved even after the drying treatment.

Figure 1:
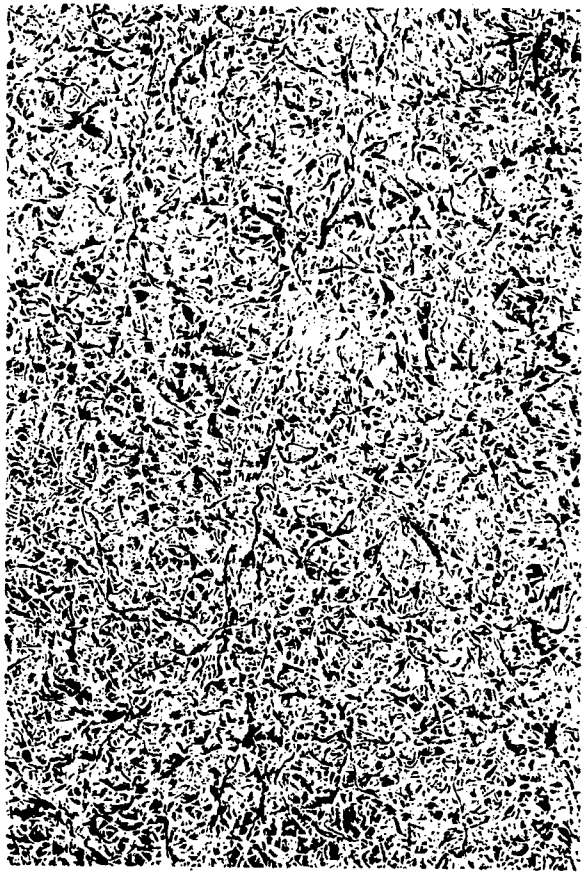
FIG. 1 shows a photographic print of a spunbonded fabric produced by the process according to the invention. This photograph was obtained by pressing the nonwoven against a photographic film and then developing the latter.

The photographic print of such a spunbonded fabric, shown in FIG. 1, clearly shows the fine loop formation of the filaments. If the spinning parameters are so chosen as to give a crystal structure which is partially in the $\gamma$-modification but in the main in the $\alpha$-modification, it is not possible to produce fabrics having anything like as high scuff resistance and smoothness after washing. The higher deniers which can be used according to the invention give a scuff-resistant, easy-care material resembling a fabric for outerwear provided the filaments have the crystal modification according to the invention.

The spunbonded fabrics manufactured according to the invention, say in accordance with the Example which follows, can be used as textile fabrics, tablecloths, decorative materials and bedlinen of good scuff-resistance and easy-care characteristics and a pleasant textile hand. The special physical structure and geometrical arrangement of the filaments in the web, provides very high wash resistance. By varying the product weight, the amount of binder introduced and the type of binder, the properties can be modified. It is also possible to mix the nylon filaments, by conventional methods, with filaments of other polymers, for example polyesters, produced by means of adjacent spinnerets. The particular use performance of the product of the invention is achieved if the nylon-6 filaments together with the binder account for the predominant proportion, by weight, of the fabric.

An example of the manufacture of such spunbonded fabrics is given below, to illustrate the invention.

EXAMPLE

Nylon-6 is spun at a throughput of 0.33 g/minute/-hole through spinnerets each of 240 holes arranged in a row at intervals of 2 mm and having a diameter of 0.4 mm. Depending on the width of the web, several of these spinnerets are arranged alongside one another. Next to the row of spinning holws, hot air at 270° C issues from the slits at a velocity of 130 m/sec. Tertiary air 6 at 80° C and a humidity of 12 g/m$^3$ of air is blown into the tunnel 4 in an amount which results in a velocity of about 3,000 m/min in the middle of the tunnel. The distance between the spinneret 1 and the upper end of the tunnel is from 25 to 40 mm. The spinning chamber air (secondary air) 7 drawn in by the tunnel through injector action is at 45° and its humidity is 8 g/m$^3$ of air. The same air conditions prevail in the conditioning zone 15.

A nonwoven containing 35 g of filaments/m$^2$ and having an average molecular orientation of 58% is produced and takes up 10 g of solid binder/m$^2$ in each of the subsequent impregnations. The web passes through the individual parts of the dryer at from 135° to 140° C. The binder used is an aqueous dispersion of a polyacrylate mixture, having a solids concentration of 15% and a foam density of 130 g/l.

If the velocity of the drawing air (tertiary air) 6 is too high, the desired properties do not result and the crystalline regions of the filament then do not predominantly consist of the $\gamma$-modification in accordance with the invention. By varying the humidity and cooling conditions of the filaments by reducing the tertiary air 6 and/or the secondary air 7 the filament properties in the spinning line can be modified so that the subsequent performance of the fabric is poorer. Whilst it is frequently still possible to obtain the $\gamma$-structure by a very high degree of attenuation of the filaments, this structure is in such cases unstable and changes to a more stable $\alpha$-structure after only brief heating, above all in an atmosphere of high humidity.

We claim:

1. A spunbonded fabric at least the major proportion by weight of which is continuous nylon-6 filaments and wherein said filaments are substantially in the $\gamma$-crystal modification in their crystalline regions and exhibit an average molecular orientation, produced by attenuation, of at most 80% of the theoretically possible orientation.

2. A fabric as claimed in claim 1 which is bonded with a polyacrylate binder.

3. A fabric as claimed in claim 1 which has been bonded with a polyurethane binder.

4. A fabric as claimed in claim 1, wherein the nylon-6 filaments average from 0.4 to 3 dtex.

5. A fabric as claimed in claim 1 wherein said filaments are arranged in a finely tangled pattern and with an arc-shaped deflection normal to the face of the fabric.

6. A process for the manufacture of spunbonded fabric from nylon-6 filaments which process comprises the steps of a. melt-spinning said filaments;

b. drawing said filaments by air jet apparatus provided in the spinning chamber, with the aid of a first stream of air which is drawn from said chamber to centrally enter the air jet apparatus in the direction of travel of the filaments, and of a second stream of air which is fed to the air jet apparatus laterally and at an acute angle to said direction;

c. laying down said filaments to form a web; and d. bonding said filaments by application of binder and subsequent drying;

and in which step (b) includes keeping the rate of flow of said second stream of air sufficiently low, and choosing the temperature and humidity of said streams of air, so that said filaments are substantially in the $\gamma$-crystal modification in their crystalline regions and the average molecular orientation, produced by attenuation, of the nylon-6 filaments is at most 80% of the theoretically possible orientation.

7. The process as claimed in claim 6 wherein said process between steps (c) and (d) comprises the further step of passing the unbonded web through a humid atmosphere so as to cause said filaments to absorb water and hence to swell and extend.

8. The process as claimed in claim 7 wherein said further step includes passing the unbonded web through a humid atmosphere in such a way that said filaments are caused to absorb up to 4% by weight of water.

9. The process as claimed in claim 7 wherein said further step includes passing the unbonded web through a humid atmosphere while said filaments are held at discrete points on a perforated belt to which suction is applied from below whereby an arc-shaped deflection of the filaments, normal to the face of the fabric, is produced.

* * * * *